US005108462A

United States Patent [19]

Habeeb et al.

[11] Patent Number: 5,108,462

[45] Date of Patent: * Apr. 28, 1992

[54] SMOKE REDUCING ADDITIVE FOR TWO-CYCLE ENGINE LUBRICANT-FUEL MIXTURE

[75] Inventors: Jacob J. Habeeb, Westfield, N.J.; Christopher J. May, Sarnia, Canada

[73] Assignee: Exxon Research and Engineering Company, Florham Park, N.J.

[ * ] Notice: The portion of the term of this patent subsequent to Dec. 31, 2008 has been disclaimed.

[21] Appl. No.: 634,984

[22] Filed: Dec. 27, 1990

[51] Int. Cl.[5] ..... C10M 137/04; C10L 1/22

[52] U.S. Cl. ..... 44/383; 252/46.7 R; 252/32.7 R

[58] Field of Search ..... 44/383; 252/32.7 R, 252/46.7 R

[56] References Cited

U.S. PATENT DOCUMENTS

| | | | |
|---|---|---|---|
| 3,791,871 | 2/1974 | Rowley | 429/118 |
| 4,001,043 | 1/1977 | Momyer | 429/206 |
| 4,218,520 | 8/1980 | Zorowls | 429/27 |
| 4,714,240 | 3/1989 | Zorowls | 429/15 |
| 4,910,104 | 3/1990 | Roo et al. | 429/118 |

*Primary Examiner*—Brian E. Hearn
*Assistant Examiner*—Maria Nuzzolillo
*Attorney, Agent, or Firm*—John W. Ditsler

[57] ABSTRACT

A lubricant-fuel mixture containing an amine salt and/or amide of a thiobenzoic acid derivative is effective in reducing the smoke emitted during operation of a two-cycle internal combustion engine. A preferred thiobenzoic acid derivative is 4-hydroxy-3,5-ditert-dibutyldithiobenzoate.

14 Claims, No Drawings

SMOKE REDUCING ADDITIVE FOR TWO-CYCLE ENGINE LUBRICANT-FUEL MIXTURE

BACKGROUND OF THE INVENTION

1. Field of the Invention

This invention relates to a lubricant-fuel mixture for two-cycle internal combustion engines in which the mixture has reduced smoke emission due to the presence of an amine salt and/or amide of a derivative of thiobenzoic acid.

2. Description of Related Art

In the last several years, the use of spark-ignited two-cycle internal combustion engines has increased significantly. This is due to their use in a variety of garden and recreational equipment such as motorcycles, marine outboard engines, snowmobiles, power mowers, snow blowers, chain saws, and the like. As such, the amount of smoke released from two-cycle engines has become a major environmental concern to engine manufacturers and fuel suppliers. However, few smoke reducing additives are commercially available, and the few that are contain metals, which are environmentally undesirable.

Amine salts of certain benzoic acid derivatives have been used as extreme pressure (EP) agents for water-based metal cutting fluids. For example, Japanese Patent No. 55023132 describes a water-based metal cutting fluid containing an EP agent comprised of an alkali metal salt, an ammonium salt, an amine salt, or an ester of a halogenated benzoic acid derivative such as hydroxy benzoic acid, alkoxy benzoic acid, alkyl benzoic acid etc. The EP agent is claimed to have excellent lubricating property, rusting resistance, and EP properties as compared with conventional nitrites typically used for water-based metal cutting fluids.

Substituted benzoic acids have also been used as EP agents in water-based fluids. For example, U.S. Pat. No. 4,569,776 discloses a water-based hydraulic fluid composition comprising substituted aromatic compounds like benzoic acids, aromatic sulfonic acids, phenyl alkyl acids and substituted benzenes. Examples of these compounds include mono-, di-, and triaminobenzoic acids; alkyl-substituted ($C_1$ to $C_{12}$ atoms) mono-, di-, and triaminobenzoic acids and mono-, di-, and trialkoxy ($C_1$ to $C_{12}$ atoms) benzoic acids.

U.S. Pat. No. 4,434,066 discloses a water based hydraulic fluid containing a combination of a hydroxyl-substituted aromatic acid component and a nitroaromatic compound component. Suitable acidic materials include saturated and unsaturated aliphatic carboxylic and polycarboxylic acids having at least six carbon atoms, aromatic carboxylic acids and alkali metal or organic amine salts of said aliphatic and aromatic acids.

U.S. Pat. No. 4,012,331 discloses a lubricating oil composition comprising a sulfur compound prepared by reacting a trithiolan compound with a thiol compound in the presence of a base where the thiol compound comprises thiophenol, thiosalicylic acid, thioacetic acid, thioglycolic acid, thiobenzoic acid, etc., including an amine or alkali metal salt thereof.

More recently, the use of the additives of this invention as an antioxidant in lubricating oils and as a flow improver in middle distillates has been disclosed in copending applications U.S. Ser. Nos. 582,316 and 545,002, respectively.

However, none of these publications suggest the particular additive for the two-cycle engine lubricant-fuel mixture disclosed herein or its effectiveness in reducing the smoke formed during combustion of the mixture.

SUMMARY OF THE INVENTION

This invention concerns a two-cycle engine lubricant-fuel mixture that comprises (a) a lubricating oil basestock, (b) a distillate fuel, and (c) an oil-soluble hydrocarbyl substituted amine salt and/or amide, preferably an amine salt, of a compound having the formula:

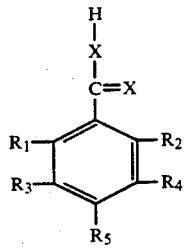

wherein X is oxygen or sulfur, preferably sulfur, and $R_1$, $R_2$, $R_3$, $R_4$ and $R_5$ are selected from hydrogen; a hydrocarbyl group containing from 1 to 24 carbon atoms, preferably an alkyl group containing from 1 to 18 carbon atoms; a hydroxy group, i.e., —OH; and an oxygen-containing hydrocarbyl group containing 1 to 24 carbon atoms and at least one of the radicals $R_1$, $R_2$, $R_3$, $R_4$ or $R_5$ is a hydrocarbyl, preferably an alkyl group, containing from 1 to 18 carbon atoms, more preferably from 1 to 6 carbon atoms. The radicals $R_3$ and $R_4$ are most preferably t-butyl groups.

In another embodiment, this invention concerns a method for reducing smoke emission from a two-cycle internal combustion engine by operating the engine with the lubricant-fuel mixture described above.

DETAILED DESCRIPTION OF THE INVENTION

In general, the two-cycle engine lubricant-fuel mixture of this invention requires a lubricating oil basestock, a distillate fuel, and an amine salt and/or amide of a derivative of benzoic acid or dithiobenzoic acid. However, if desired, other lubricant and distillate fuel additives may be present in the mixture as well.

The lubricating oil basestock can be derived from natural lubricating oils, synthetic lubricating oils, or mixtures thereof. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes e.g. dodecylbenzenes, tetradecylbenzenes, dinonylbenzenes, di(2-ethylhexyl)benzene, etc.); polyphenyls e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerylthritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

If desired, other additives known in the art may be added to the lubricating base oil. Such additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. 4,105,571, the disclosures of which are incorporated herein by reference.

The distillate fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g. methanol, ethanol, diethyl ether, methyl ethyl ether, nitromethane), are also within the scope of this invention as are liquid fuels derived from vegetable or mineral sources such as corn, alfalfa, shale, and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels may also contain other additives which are well known to those skilled in the art. These can include anti-knock agents such as tetra-alkyl lead compounds, lead scavengers such as halo-alkanes (e.g., ethylene dichloride and ethylene dibromide), dyes, cetane improvers, anti-oxidants such as 2,6-di-tertiary-butyl-4-methylphenol, rust inhibitors such as alkylated succinic acids and anhydrides, bacteriostatic agents, gum inhibitors, metal deactivators, demulsifiers, upper cylinder lubricants, antiicing agents, and the like. This invention is useful with lead-free as well as lead containing fuels.

The lubricant-fuel mixture of this invention will also contain a hydrocarbyl substituted amine salt and/or amide, preferably an amine salt, of an oil-soluble thiobenzoic acid derivative having the formula:

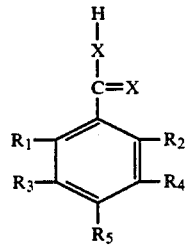

wherein X is oxygen or sulfur, preferably sulfur, and $R_1$, $R_2$, $R_3$, $R_4$ and $R_5$ are selected from hydrogen; a hydrocarbyl group containing from 1 to 24 carbon atoms, preferably an alkyl group containing from 1 to 18 carbon atoms; a hydroxy group, —OH; and an oxygen-containing hydrocarbyl group containing from 1 to 18 carbon atoms and at least one of the radicals $R_1$, $R_2$, $R_3$, $R_4$ or $R_5$ is a hydrocarbyl, preferably an alkyl group, containing from 1 to 18 carbon atoms, most preferably from 1 to 6 carbon atoms.

Specific examples of the benzoic or dithiobenzoic acid derivatives include 4-hydroxy 3,5 ditertiary butyl dithiobenzoic acid; 4-hydroxy 3,5 ditertiary butyl benzoic acid; 3,5 dimethyl dithiobenzoic acid; 4-hydroxy 3,5 dimethyl dithiobenzoic acid and the like.

The oil soluble additive is formed in a conventional manner by mixing substantially equimolar amounts of the benzoic acid derivative and a hydrocarbyl substituted amine at temperatures generally in the range of 20° C.-100° C.

The hydrocarbyl groups of the amine include groups which may be straight or branched chain, saturated or unsaturated, aliphatic, cycloaliphatic, aryl, alkaryl, etc. Said hydrocarbyl groups may contain other groups, or atoms, e.g. hydroxy groups, carbonyl groups, ester groups, or oxygen, or sulfur, or chlorine atoms, etc. These hydrocarbyl groups will usually be long chain, e.g. $C_{12}$ to $C_{40}$, e.g. $C_{14}$ to $C_{24}$. However, some short chains, e.g. $C_1$ to $C_{11}$ may be included as long as the total numbers of carbons is sufficient for solubility. Thus, the resulting compound should contain a sufficient hydrocarbon content so as to be oil soluble. The number of carbon atoms necessary to confer oil solubility will vary with the degree of polarity of the compound. The compound will preferably also have at least one straight chain alkyl segment extending from the compound containing 8 to 40, e.g. 12 to 30 carbon atoms.

The amines may be primary, secondary, tertiary or quaternary, but preferably are secondary. If amides are to be made, then primary or secondary amines will be used.

Examples of primary amines include n-dodecyl amine, n-tridecyl amine, $C_{13}$ Oxo amine, coco amine, tallow amine, behenyl amine, etc. Examples of secondary amines include methyl-lauryl amine, dodecyl-octyl amine, coco-methyl amine, tallow-methylamine, methyl-n-octyl amine, methyl-n-dodecyl amine, methyl-behenyl amine, ditallow amine etc. Examples of tertiary amines include coco-diethyl amine, cyclohexyl-diethyl amine, coco-dimethyl amine, tri-n-octyl amine, dimethyldodecyl amine, methyl-ethyl-coco amine, methyl-cetyl stearyl amine, etc.

Amine mixtures may also be used and many amines derived from natural materials are mixtures. The preferred amines include the long straight chain alkyl amines containing from 8 to 40, preferably from 12 to 24, carbon atoms. Naturally occurring amines, which are generally mixtures, are preferred. Examples include coco amines derived from coconut oil which is a mixture of primary amines with straight chain alkyl groups ranging from $C_8$ to $C_{18}$. Another example is di tallow amine, derived from hydrogenated tallow acids, which amine is a mixture of C14 to C18 straight chain alkyl groups. Ditallow amine is particularly preferred.

Oil-soluble, as used herein, means that the additive is soluble in the mixture at ambient temperatures, e.g., at least to the extent of about 5 wt.% additive in the mixture at 25° C.

As is well known to those skilled in the art, two-cycle engine lubricating oils are often added directly to the fuel to form a mixture of oil and fuel which is then introduced into the engine cylinder. Such lubricant-fuel blends generally contain per 1 part of oil about 20-250 parts fuel, typically they contain 1 part oil to about 30-100 parts fuel.

The amount of additive in the mixture can vary broadly depending on the lubricant-fuel mixture ratio. Accordingly, only an amount effective in reducing the smoke of the mixture need be added. In practice, however, the amount of additive added will range from about 0.1 to about 5, preferably from about 0.5 to about 1 wt.%, based on weight of lubricant in the lubricant-fuel mixture.

The invention will be further understood by reference to the following Example, which includes a preferred embodiment of the invention.

Example

Three samples of the same lubricant-fuel mixture were tested in a single cylinder Yamaha snowmobile engine to determine the maximum smoke produced by each sample. The mixture comprised a commercially available two-cycle engine lubricating oil and a commercially available unleaded gasoline having an RON of 91 and an oil to fuel ratio of 1 to 33. The samples tested were the lubricant-fuel mixture without additives, the mixture with a conventional smoke reducing additive (barium sulfonate), and the mixture with an additive of this invention (DTA:DTB=Dihydrogenated tallow amine:4-hydroxy-3,5-ditert-butyldithiobenzoate). The maximum smoke produced when operating the engine at 4500 rpm and applying a 10 Nm (Newton meter) load was measured by inserting an optical opacity smokemeter into the exhaust system. The results obtained are shown in Table 1 below.

TABLE 1

| Test No. | Additive | Cone, wt. % | Max. Smoke, % | Smoke Reduction, % |
|---|---|---|---|---|
| 1 | None | — | 49.6 | — |
| 2 | DTA:DTB | 1.0 | 39.4 | 21 |
| 3 | Ba Sulfonate | 1.0 | 39.8 | 20 |

The data in Table 1 show that the additives of this invention provide a reduction in smoke comparable with that of barium sulfonate (a commercially available additive) without the formation of ash.

What is claimed:

1. A lubricating oil-fuel mixture comprising (a) a lubricating oil basestock, (b) a distillate fuel, and (c) an oil-soluble additive comprised of a hydrocarbyl substituted amine salt or amide of a compound having the formula:

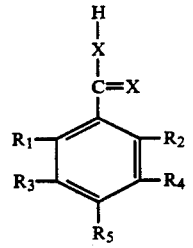

wherein X is oxygen or sulfur, and $R_1$, $R_2$, $R_3$, $R_4$ and $R_5$ are selected from hydrogen; a hydrocarbyl group containing from 1 to 24 carbon atoms; a hydroxy group, and an oxygen-containing hydrocarbyl group containing from 1 to 24 carbon atoms and at least one of the radicals $R_1$, $R_2$, $R_3$, $R_4$ or $R_5$ is a hydrocarbyl group containing from 1 to 24 carbon atoms.

2. The mixture of claim 1 wherein the hydrocarbyl substituted amine used in the preparation of the oil-soluble additive comprises at least one straight chain alkyl group containing from 8 to 40 carbon atoms.

3. The mixture of claim 2 wherein the oil-soluble additive is an amine salt.

4. The mixture of claim 3 wherein at least one of the radicals $R_1$, $R_2$, $R_3$, $R_4$ or $R_5$ is a hydrocarbyl radical containing from 1 to 18 carbon atoms.

5. The mixture of claim 4 wherein X in the formula for the benzoic acid derivative represents sulfur.

6. The mixture of claim 5 wherein at least one of the radicals $R_1$, $R_2$, $R_3$, $R_4$ or $R_5$ is an alkyl group containing from 1 to 6 carbon atoms.

7. The mixture of claim 6 wherein at least one of the radicals $R_1$, $R_2$, $R_3$, $R_4$ or $R_5$ is a hydroxy group.

8. The mixture of claim 7 wherein the hydrocarbyl substituted amine comprises at least one straight chain alkyl group containing from 12 to 24 carbon atoms.

9. The mixture of claim 8 wherein the hydrocarbyl substituted amine is a tallow amine.

10. The mixture of claim 9 wherein the oil-soluble additive is a ditallow amine salt of 4-hydroxy-3, 5-di-tert-butyldithiobenzoic acid.

11. The mixture of claim 1 wherein from about 0.1 to about 5 wt.% of the oil-soluble additive is present therein.

12. The mixture of claim 11 wherein the volume ratio of lubricant to fuel ranges from about 20 to about 1:250.

13. The mixture of claim 12 wherein fuel is gasoline.

14. A method for reducing the smoke emitted from a two-cycle internal combustion engine by operating the engine with the mixture of claim 1.

* * * * *